United States Patent [19]

Marshall

[11] Patent Number: 4,562,764

[45] Date of Patent: Jan. 7, 1986

[54] ELECTRONIC MUSICAL PERFORMANCE

[75] Inventor: Neal Marshall, Bolton, Mass.

[73] Assignee: Kurzweil Music Systems, Inc., Waltham, Mass.

[21] Appl. No.: 618,468

[22] Filed: Jun. 8, 1984

[51] Int. Cl.[4] ..... G10H 3/00

[52] U.S. Cl. ..... 84/1.1; 84/DIG. 7

[58] Field of Search ..... 84/1.1, DIG. 7, 1.01, 84/1.24, 433

[56] References Cited

U.S. PATENT DOCUMENTS 3,927,594 12/1975 Morita ..... 84/1.01

4,111,091 9/1978 Hinago ..... 84/1.01

*Primary Examiner*—Forester W. Isen

*Attorney, Agent, or Firm*—Jerry Cohen; M. Lawrence Oliverio

[57] ABSTRACT

A keyboard for an electronic music instrument is made to have a "piano key feel" by bracketing an end of each key with the legs of a weighted A-shaped action arm which pivots about a single point and actuates a leaf spring switch.

2 Claims, 6 Drawing Figures

ELECTRONIC MUSICAL PERFORMANCE

BACKGROUND OF THE INVENTION

The present invention relates to electronic musical performance through keyboard electronic instruments, e.g. synthesizers, electric or electronic pianos and organs, and more particularly to simulation of acoustic piano response in keyboards for such instruments.

There are four principal classes of keyboard instruments distinguished by the way the applied pressure or key velocity influences the sound produced when the key is played:

(1) Clavichord-like keyboards, in which the amplitude of the note depends on initial velocity, and some other quality of the note—pitch, in the case of clavichords—depends on pressure after initial keystrike.

(2) Harpsichord-like keyboards, which resist key pressure until a note is played, and then exhibit a reduced resistance when the key remains "bottomed out." Neither loudness nor pitch of the note are affected by the velocity of the keystroke or pressure after keystrike.

(3) Organ-like keyboards, which have a more uniform resistance to key pressure than harpsichord keyboards, but which do not influence loudness or any other quality of the note no matter what the velocity of pressure.

(4) Piano-like keyboards, where the loudness of a note is dependent on the velocity of the keystroke.

As is well known in the art of piano keys, each action includes a hinged mechanism which releasably drives a hammer against sound-producing springs. This hammer action along with other weighting elements of the typical key structure, plus controlled inter-element friction, produces the "piano key feel" desired by accomplished musicians. These also make for an unloading action—a "live" feel at the bottom of the key depression, which comes from the hammer mass moving toward and away from the strings. Typical key actions also include a reasonable constant depressing force of between two and four ounces, plus the ability to return and follow the finger action up and down no matter how rapidly the pianist may "trill" a note.

Because of the musically expressive quality of the piano, which allows a skilled player to obtain crescendos, diminuendos, and accentuation, pianos are the most popular of the keyboard instruments. Most keyboard players first learn to play the piano—which requires considerable investment in time and effort in acquiring "technique"—and then may or may not wish to invest additional time and effort to acquire alternate keyboard techniques.

The present state of the art includes a number of electronic music synthesizers and electronic pianos which do have a fairly good approximation of the feel and response of an acoustic piano.

It is a principal object of the present invention to provide a significant improvement in such approximation and in technical and commercial feasibility and reliability of such apparatus.

A further specific object of this invention is provide an electronic musical instrument and a keyboard therefor which has a "feel" or response which is more like an acoustic piano than other electronic instrument keyboards.

Another specific object of this invention is to provide a new keyboard which is economical to manufacture.

Another object of this invention is to provide a new keyboard which is inherently reliable because it uses very few parts.

SUMMARY OF THE INVENTION

The invention comprises the method and apparatus, described below, and keyboard and keyboard-related components thereof, with the following elements:

(a) an array of keys and corresponding pivotal action arms, preferably pivotable about a fixed pivot axis, (b) weighting means for each action arm, (c) spring means for establishing a transfer of energy from each key to the corresponding arm with initial key movement loading a spring, then causing the arm to pivot, (d) optical or magnetic transducer means for converting the action arm movement into an electrical signal.

The means (d) comprise an array of leaf switches of the break before make type for selection of tones and imparting of tone usage information (e.g., desired decay).

Other objects, features, and advantages will be apparent from the following detailed description of preferred embodiments thereof taken in connection with the accompanying drawing, in which:

DETAILED DESCRIPTION OF PREFERRED EMBODIMENTS

Figure 1:
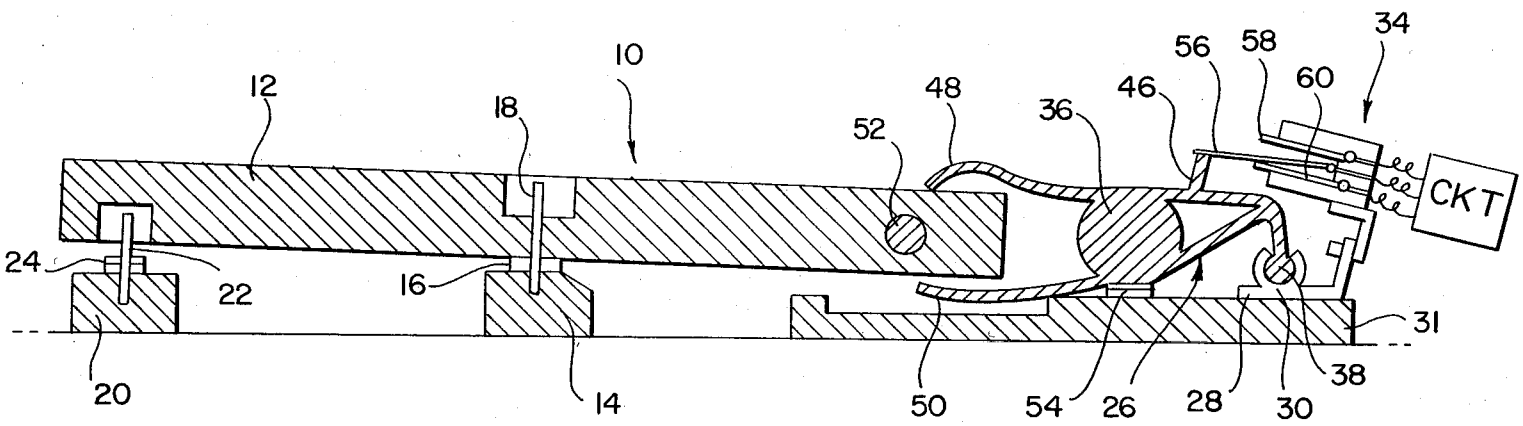
FIGS. 1–4 are cross section views of a key-action arm assembly portion of a preferred embodiment of the invention.

FIG. 1 shows an assembly 10 comprising as a portion of a keyboard of an instrument made in accordance with a preferred embodiment of the invention, a conventional arrangement of a key 12 which is supported by a key balance rail 14 which acts as a pivot to allow the key to move in a seesaw motion. A cushioning washer 16 sits between the key and balance rail, and a guidepin 18, protruding from the balance rail, and fitting loosely into a slot in the key, serves to key the key positioned properly on said rail. There is also a front rail 20, a front guidepin 22, and a front cushioning washer 24 which further serve to locate and constrain the motion of the key and to limit the amount which the key may be depressed. These are all conventional parts of piano-like keyboards, common not only to this embodiment but to many other designs.

The assembly further comprises an action arm 26, an action rail 28 containing a channel 30 truncated circular cross section, and a switch assembly 34 all mounted on a raised platform 31. The action arm consists of a strong, resilient plastic part, preferably fabricated by molding, which contains a weighted insert 36, preferably made of a heavy metal, and preferably molded in place.

The end 38 of the arm which is opposite the end with the weighted insert has a cylindrical cross-sectional shape, and fits into the channel trough of the action rail. This arrangement permits the action arm to pivot around the cylindrical end.

Figure 1B:
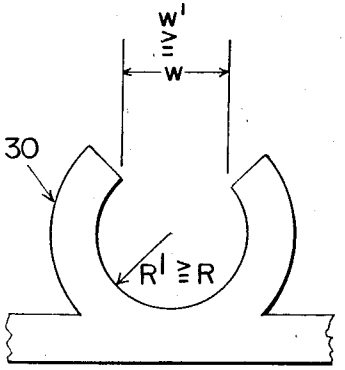
FIGS. 1A and 1B are expanded views of a portion of the FIGS. 1–4 embodiment.
Figure 1A:
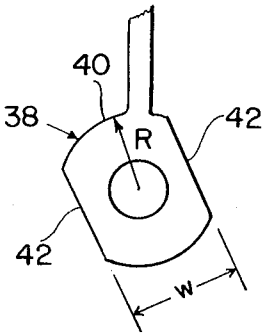

Expanded view of the action arm end 38 (FIG. 1A) and channel 30 (FIG. 1B) show that the cylindrical pivot has rounded faces 40 of radius R which function as bearings and flat faces 42 which create an insertion width W, allowing the action arm to be inserted into channel 30 between other action arms, whose cylindrical pivots are in direct contact with this action arm. Channel 30 has an insertion width W′ equal to or slightly greater than W and a radius R′ equal to or slightly greater than R.

An actuator 46 in the form of an elongated rib is located on the action arm, and shaped and positioned in such a way that it is capable of pushing against an electrical sensor—in this case a leaf spring switch which is part of the control circuit CKT of the instrument.

Two spring elements, 48 and 50, which are integral parts of the action arm, are located in a bifurcated arrangement and shaped so that the bent end of the upper spring rests on the upper surface of the key rail, and the lower spring is located just below—but not touching—the lower surface of the key tail.

Another weighted insert 52, is pressed into a cylindrical well in the key, near the tail end. This serves to provide some of the restoring force to return the key to rest position, and some of the inertial mass of the system.

A cushioning strip 54, on which the action arm rests initially, also provides a soft stop when the action arm returns after the key is released.

The leaf spring switch 34, is contacted by movement of the action arm and comprises a center leaf 56, upper leaf 58 and a lower leaf 60.

The action arm 26 is designed to receive mechanical energy from the key, and convert it into velocity for operating a velocity sensor—in this case a "break-before-make" leaf-switch 34—other types of velocity sensors, including electromagnetic, Hall-effect, electrostatic, photo-optical, etc. may be used.

The action arm 26 incorporates two kinds of energy storage elements, the two spring-arms 48 and 50, and the mass—being principally concentrated in the weight-insert 36.

Figure 2:
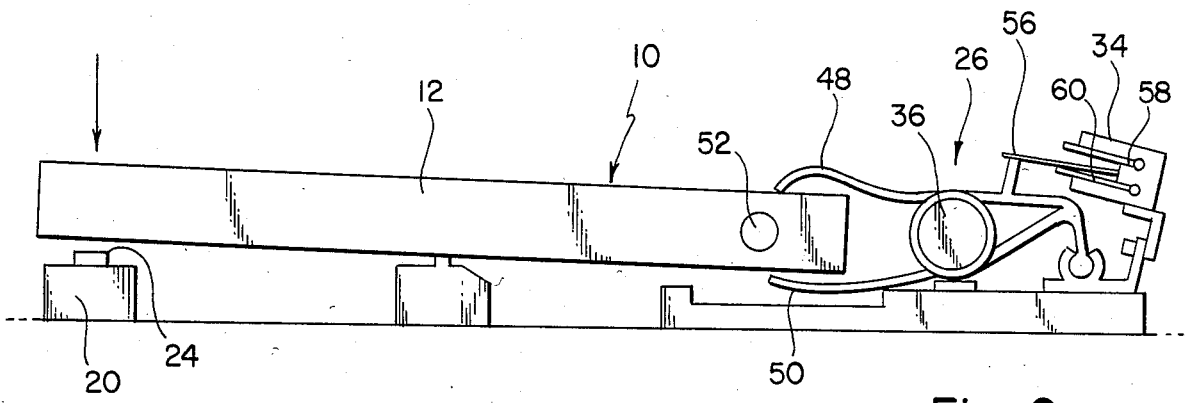
Figure 3:
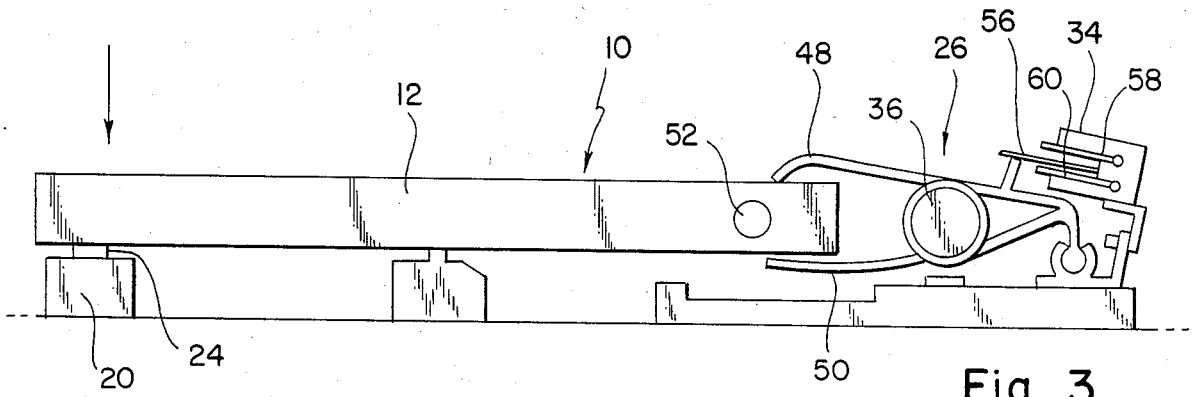
Figure 4:
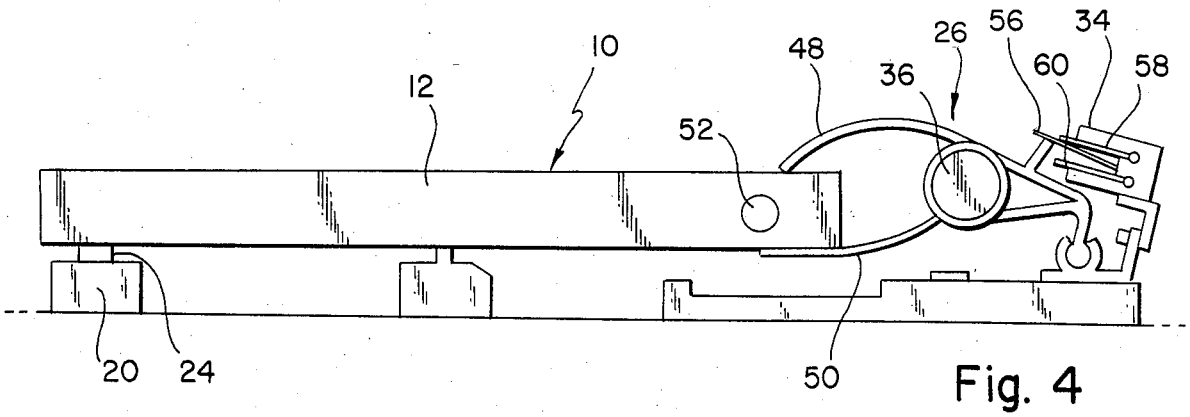

The operation and interaction of these elements is best described by referring to the simplified diagrams FIGS. 2, 3 and 4.

FIG. 2 shows a case in which the key is being depressed in response to the player's finger motion. Because of the rotational inertia of the action arm, the key tail has moved upward before the action arm starts to move. The energy imparted by the key motion is initially stored in the spring system, by deflecting the upper spring 48, as seen in FIG. 2. The switch elements are, at this point, in the inactive position, with the movable center contact leaf 58 closed to the lower contact 60.

FIG. 3 shows a later stage of movement in which the key has come to rest by reason of "bottoming out" against the cushioning washer 24 of the front rail. The action arm 26 is now in motion, however, the spring system has given up some of its deflection-stored energy to kinetic energy and rotational inertia of the action arm. This reduces delay in transition from the FIG. 2 to FIG. 3 stage. It is also seen that the switch system has begun to function, in that the contact between the center contact leaf 58 and the lower contact leaf 60 has been broken.

FIG. 4 shows return of springs 48 and 50 to their initial undeflected position with respect to the action arm, with the key being in the depressed state, and the action arm consequently being in the upper rest state. In this condition the upper contact leaf 58 of the switch 56 has now been closed to the center contact leaf 58.

Not shown, but easily visualized, is the "overshoot condition" which is encountered when the key is depressed hard, with a high velocity imparted to the action arm. In this case, the action arm moves upward even more—beyond the position shown in FIG. 4—causing spring 50 to be bent downward. When the upward deflection of the action arm reaches a peak value, the action arm stops its motion, and then reverses its direction downward. At this point the action arm oscillates a bit, with much of the energy being transmitted back to the key. This oscillation is damped out by losses in the key system, with much of the energy going into friction between the springs 48 and 50 and the key. This friction is augmented by the use of felt strips—shown by not numbered—placed between the key rail and said springs.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. In combination with a keyboard having an array of pivoted keys, an action arm assembly for interacting with each keyboard key and comprising:

(a) means defining a pivotal action arm and pivot defining means therefor associated with each key, (b) means defining a weighting of each action arm, (c) means defining spring extensions of the action arm bracketing the associated key with one such spring constructed to yield initially on key depression and restore so that the action arm pivots, (d) means for converting action arm movement into a key-movement-related signal and wherein the action arm has an A-yoke form with a weighted A-bar and legs defining said springs as leaf-form springs for bracketing a key end.

2. Apparatus in accordance with claim 1 wherein the spring leg for encountering initial key movememt is shorter than the other spring leg.

* * * * *